US009776070B2

(12) United States Patent
Medansky

(10) Patent No.: US 9,776,070 B2
(45) Date of Patent: Oct. 3, 2017

(54) MELDING CARD GAME AND METHOD OF PLAY

(71) Applicant: Paddy O'Shea's Golf Card Game, LLC, Scottsdale, AZ (US)

(72) Inventor: David B. Medansky, Glendale, AZ (US)

( * ) Notice: Subject to any disclaimer, the term of this patent is extended or adjusted under 35 U.S.C. 154(b) by 556 days.

(21) Appl. No.: 14/020,812

(22) Filed: Sep. 7, 2013

(65) Prior Publication Data

US 2014/0232066 A1 Aug. 21, 2014

Related U.S. Application Data

(60) Provisional application No. 61/850,532, filed on Feb. 19, 2013.

(51) Int. Cl.
*A63F 1/00* (2006.01)
*G07F 17/32* (2006.01)

(52) U.S. Cl.
CPC ..... *A63F 1/00* (2013.01); *G07F 17/32* (2013.01); *A63F 2001/006* (2013.01); *G07F 17/3293* (2013.01)

(58) Field of Classification Search
CPC ..... A63F 2001/006; A63F 1/00; A63F 2002/006; A63F 1/00273
USPC ..... 273/292, 274, 309; 463/13, 12
See application file for complete search history.

(56) References Cited

U.S. PATENT DOCUMENTS 4,170,358 A 10/1979 Hancock
4,289,315 A 9/1981 O'Barr
4,480,840 A 11/1984 Chang
4,546,982 A 10/1985 Gaines
5,165,693 A 11/1992 Handlon, Sr.
5,435,568 A 7/1995 Black
5,711,526 A * 1/1998 Van Hollebeke ..... 273/303
5,816,576 A * 10/1998 Aramapakul et al. ..... 273/292
5,887,873 A 3/1999 Freeman
6,247,697 B1 6/2001 Jewett
6,685,189 B2 * 2/2004 Cherven ..... 273/304
7,850,527 B2 12/2010 Barney et al.
7,946,911 B2 5/2011 Vang et al.
2008/0309011 A1 * 12/2008 Crawford ..... 273/304

OTHER PUBLICATIONS

The Way to Play, The Illustrated Encyclopedia of the Games of the World, The Diagram Group, Paddington Press Ltd., 1975, "Michigan" p. 100, "Canasta" p. 111.*

* cited by examiner

*Primary Examiner* — Benjamin Layno
(74) *Attorney, Agent, or Firm* — Thomas W. Galvani, P.C.; Thomas W. Galvani

(57) ABSTRACT

A melding card game and method of play includes 114 numbered, face, ace, mulligan, joker, and wild cards. A round is played in which nine layout cards are dealt face-down to players and arranged in a grid. Each player turns at least one layout card face up and takes a turn. In the turn, each player draws a drawn card from a discard or draw pile and plays or discards the drawn card. If the player plays the drawn card, the player replaces a layout card with the drawn card. The players play one additional turn after an ender player turns all of their respective cards face up. A score for each player is then determined. A penalty is assigned to the ender player if another player has a lower score. Nine rounds are played. The player with the lowest total score is declared the winner.

17 Claims, 4 Drawing Sheets

100

Set Up
101
New Round Begins
102
Two Cards Turned
103
First Player's Turn
104
Next Player's Turn
105
Any Player With All Cards Up?
106
No
Cards Remain In Draw Pile?
107
Yes
No
Yes
One Additional Turn
108
Modified Game Play
300
All Cards Turned
109
Determine Score
110
Round Ends
111
Nine Rounds Played?
112
No
Yes
End of Game
113

MELDING CARD GAME AND METHOD OF PLAY

CROSS-REFERENCE TO RELATED APPLICATIONS

This application claims the benefit of U.S. Provisional Application No. 61/850,532, filed Feb. 19, 2013, which is hereby incorporated by reference.

FIELD OF THE INVENTION

The present invention relates generally to games, and more particularly to melding card games.

BACKGROUND OF THE INVENTION

Card games are widely played by adults, young adults, teenagers, and children. They are an important component of recreational activities, providing amusement for many people. Many games are not only fun and entertaining, but interesting, challenging, stimulating, and educational.

Many games are so fun, challenging, and educational, in fact, that often times many people want to play together in one game. Unfortunately, in games which use standard 52-card decks, the cards are exhausted quickly, either because they are dealt out to the many players, or because the players draw and discard them rapidly. Exhaustion of the cards usually requires a dealer to frequently collect discards and reshuffle them for use in a "new" draw pile. Further, in some games, special rules call for special cards, but a standard 52-card deck has no special cards. Thus, some cards are forced into roles as "wild" cards or other special cards. For instance, a Jack with an Axe may be designated to have special significance in a game, or a Joker may be added to the deck to accommodate the special rules of the game. While the 52-card pack of cards is wonderful for its portability and versatility, in some games, it is not adequate.

Various games with greater numbers of cards or specially designed cards have been developed. Games like Uno® and Skip-Bo® use more than the conventional two through ten numbered cards and face cards to accommodate the special rules of those games. Moreover, those games often have special cards which instruct the players to take a special action, such as "Reverse" or "Draw Four." These games are exciting and fun as they represent a departure from more traditional card games based on 52-card decks.

Some games test the ability of the players to make matches, rewarding them for making as many matches as possible. In games like Pinochle, Gin, and Rummy, matches, melds, or runs are awarded points based on the cards used to make the match, meld, or run. These games demand intelligence, strategy, and a little bit of luck to be successfully played, and are intriguing to many people. With all the card games that can be played, however, there is always a desire for a new, improved card game.

SUMMARY OF THE INVENTION

According to the principle of the invention, a melding card game uses a deck of 114 cards including seventy-two numbered cards, twenty-four face cards, eight ace cards, four joker cards, four mulligan cards, and two wild cards. Each player is dealt nine layout cards, and each layout card has a value. Each player attempts to keep his score as low as possible. Each card has a value that is added to the score of the player unless that card is part of a meld. The player thus draws cards from a discard pile or a draw pile with the object of replacing his layout cards with the drawn card to make a meld or lower his score. The drawn card may or may not help the player; he has to decide whether to play the drawn card or not. Nine rounds are played, and each player's score is determined for a round and added to a total score. The player with the lowest total score at the conclusion of the ninth round is declared the winner.

BRIEF DESCRIPTION OF THE DRAWINGS

Referring to the drawings.

DETAILED DESCRIPTION

Figure 1:
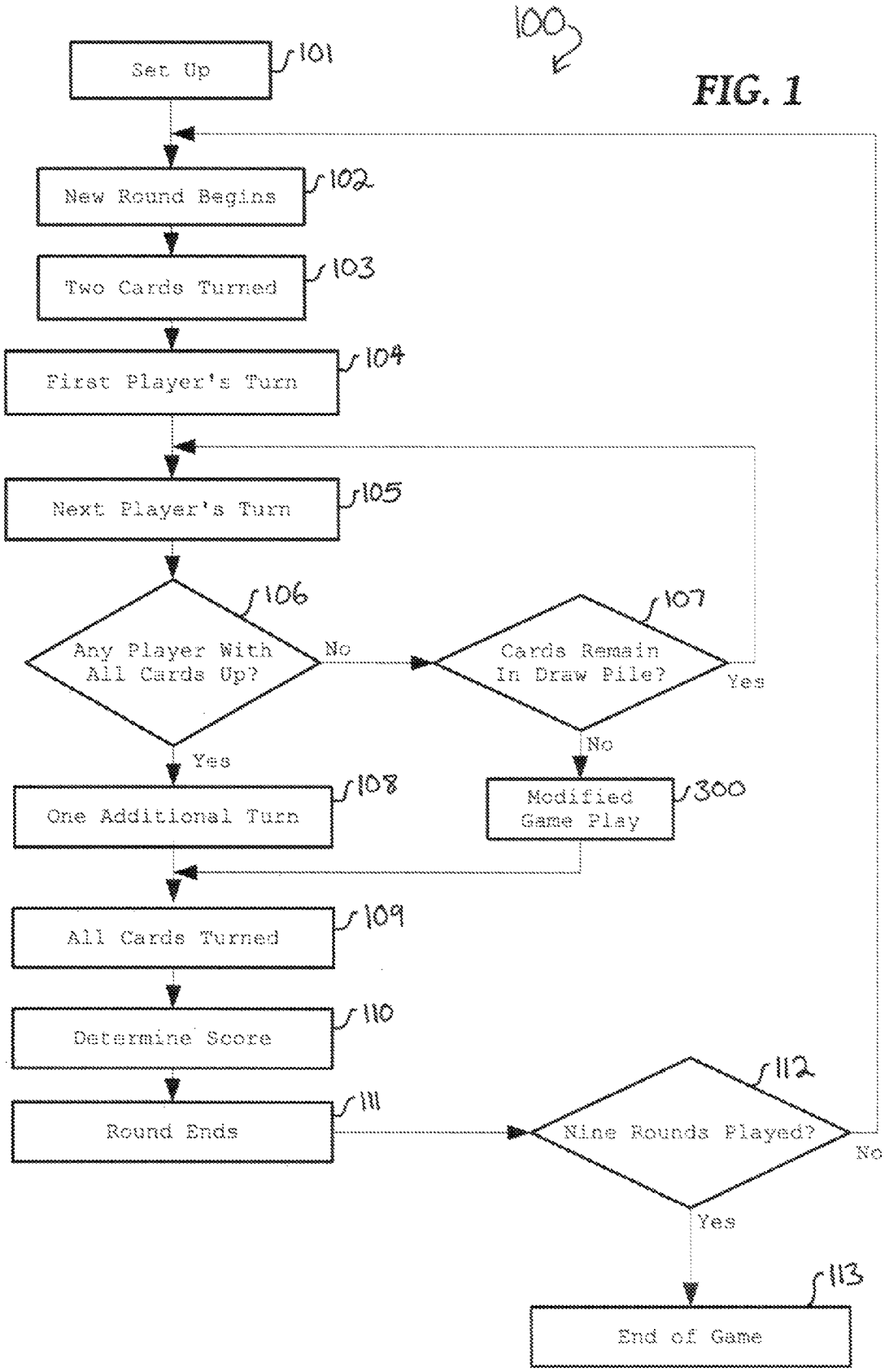
FIG. 1 is a process flow diagram illustrating a sequence of steps involved in playing a melding card game according to the principle of the invention.
Figure 2:
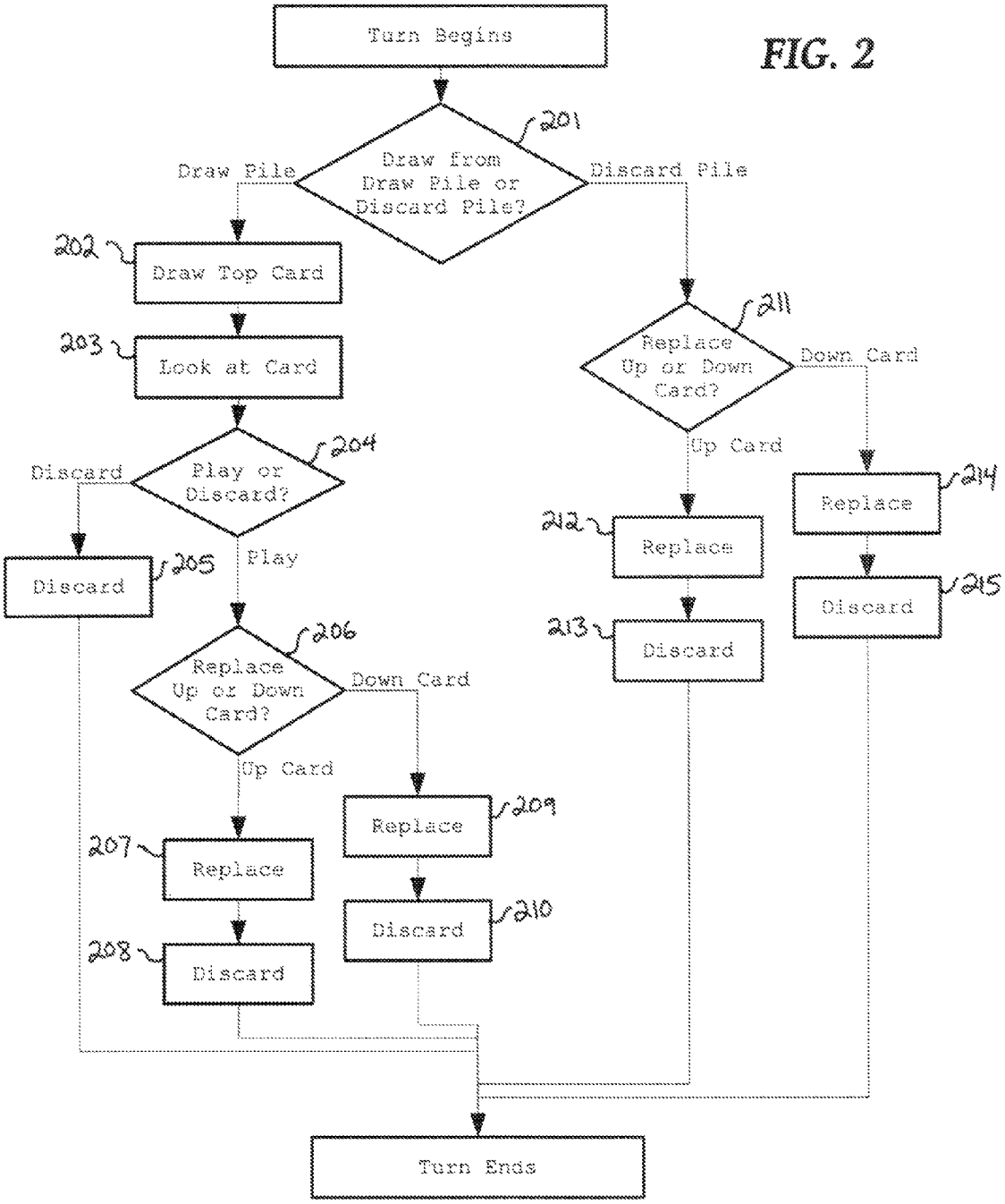
FIG. 2 is a process flow diagram illustrating a turn in the melding card game of FIG. 1.
Figure 3:
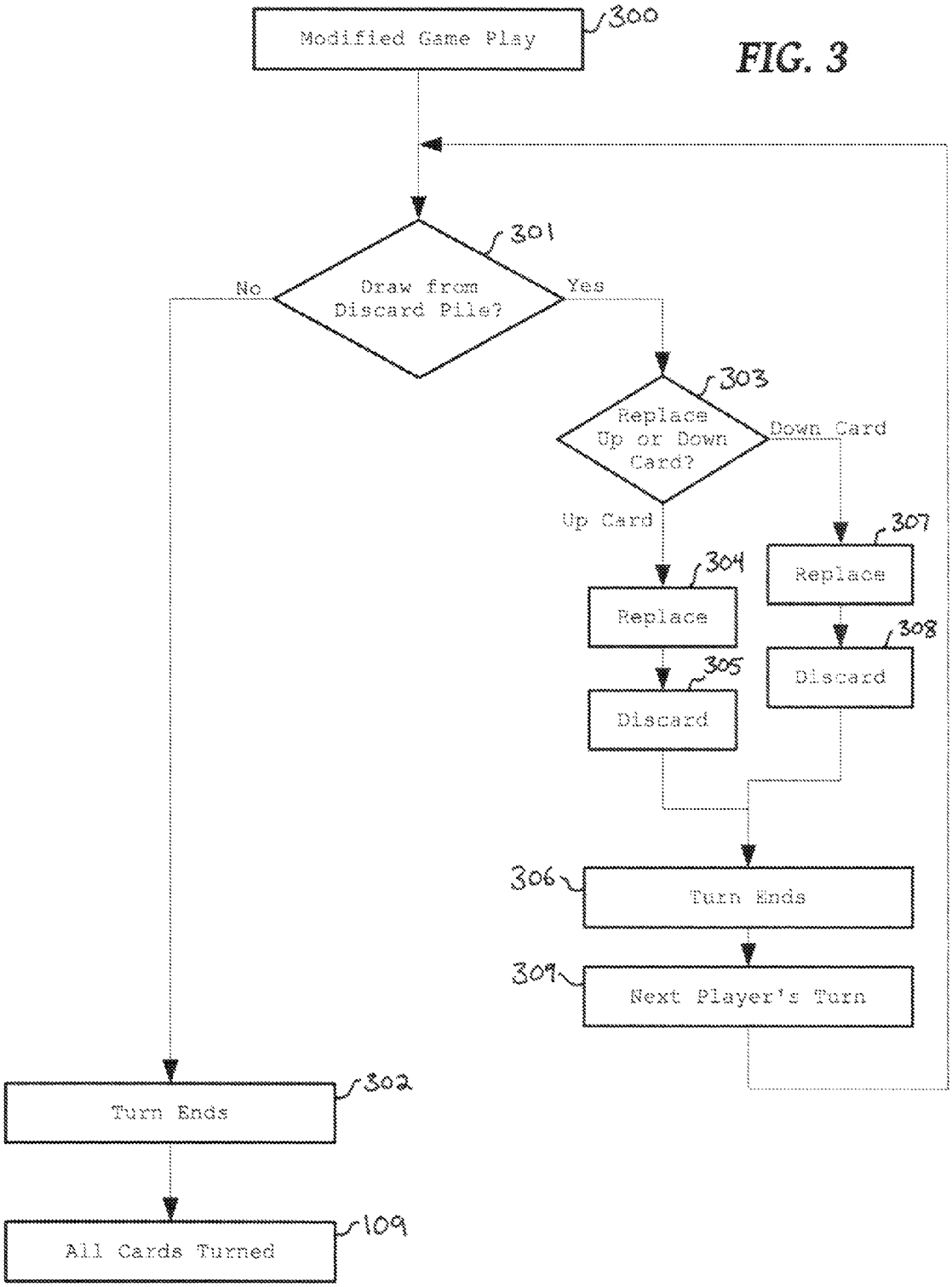
FIG. 3 is a process flow diagram illustrating modified game play of the melding card game of FIG. 1.
Figure 4A:
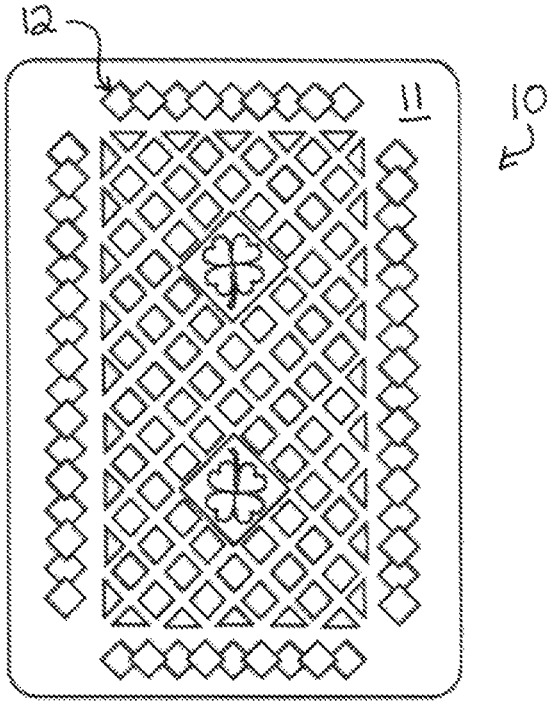
FIGS. 4A and 4B illustrate a card used in the melding card game of FIG. 1.
Figure 4B:
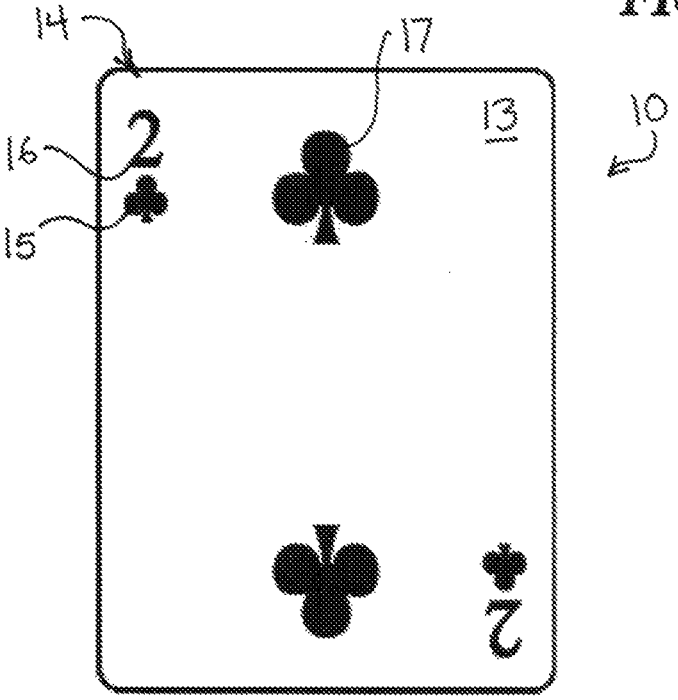

Reference now is made to the drawings, in which the same reference characters are used throughout the different figures to designate the same elements. FIGS. 1, 2, and 3 are process flow diagrams of the melding card game 100 and game play according to the principle of the invention. A representative card 10 used in the game 100 is shown in FIGS. 4A and 4B. The game 100 is suitable for between two and six players to participate and play. The game is preferably played with cards and players in the physical world, but one having reasonable skill in the art will readily appreciate that the game may also be played on a computer with computer opponents or on a computer network with other human or computer opponents. A deck of cards is used which preferably has 114 cards. The deck of cards can be distributed among two, three, four, five, or six players so that each player receives a complete hand, and no cards are left remaining to be used to the advantage of some players over other players. Like conventional playing cards, the cards are two-sided, having a back 11 which carries a decorative display 12 or design common to the backs 11 of all of the cards 10 and reveals no unique information about the card 10, and an opposed face 13 which displays card characteristics 14 that distinguish the cards, such as a suit 15, rank or number 16, color 17, and like characteristics. The game expands beyond the standard range of conventional cards, however.

The 114 cards 10 used in the game 100 include two sets of cards 10 in the Heart, Spade, Diamond, and Club suits from 2-10, as well as Ace, King, Queen, and Jack cards. With nine numbered cards and four face cards in each suit, two sets equals 104 cards. Additionally, the deck includes four Joker cards, four Mulligan cards, and two $19^{th}$ Hole Wild ("Wild") cards. The Joker, Mulligan, and Wild cards are not suited. The game 100 begins with set up in step 101 on FIG. 1, during which the players congregate and the deck is provided.

The players arrange themselves preferably at a flat surface and game play begins with a new round, as shown in step 101 in FIG. 2. In the round, one player is designated as the dealer. The dealer has a special position and role; while the dealer participates in game play as a player, she also has further responsibilities not shared by the other players, and game plays proceeds according to the players' seating with respect to the dealer. The dealer shuffles the deck several times until the cards 10 are sufficiently randomized and then deals the cards 10 to the players. Each player receives nine cards 10, with the dealer preferably dealing a first card to each player in turn, beginning with the player to the dealer's left, then a second card to each player, then a third card to each player, and so on until a ninth card has been dealt to each player. Each card is dealt in a face-down orientation, in which the back of the card is toward the players, the face of the card is against the surface, and the characteristics of the cards are hidden from sight.

Each player arranges his own cards, maintaining the cards in a face-down orientation. As a side note, for clarity, the female designators "she" and "her" will be used to designate the dealer, and the male designators "he" and "his" will be used to designate the players, which also includes the dealer. When the dealer alone is referred to, the female designator will be used, while when the players are referred to and the dealer is meant to be included as a player, the male designator will be used. Thus, "each player arranges his own cards" is intended to mean that all of the players, including the dealer, arrange their own cards. Obviously, the use of male and female designators is not meant to limit the roles of the dealer and players in any way. Each player arranges his cards in front of himself in a three-by-three grid of cards, or, in other words, in three rows of three cards each. The cards dealt and arranged in front of a player are referred to as layout cards, and the following notation will be used to illustrate layout cards in front of a given player:

*X X X* Example A

*X X X*

*X X X*

In the notation used above in Example A, each of the layout cards is represented by an X because the card is in a face-down orientation and the characteristics of the card are not known. Further, for reference in this description, each of the positions of the layout cards is identified by row and column coordinates as (row,column) according to the position in the grid, with the top left position corresponding to the (1,1) position, the top right position corresponding to the (1,3) position, the bottom left position corresponding to the (3,1) position, and the bottom right position corresponding to the (3,3) position. Further, each card is represented in the above notation with an abbreviation according to Table 1 below. Once the layout cards are initially arranged, each layout card remains in its initial position, and no layout card may be moved unless it is being discarded or turned to a face-up orientation.

TABLE 1

| Abbreviation | Card | Value |
|---|---|---|
| A | Ace | 1 |
| 2 | 2 | 2 |
| 3 | 3 | 3 |
| 4 | 4 | 4 |
| 5 | 5 | 5 |
| 6 | 6 | 6 |
| 7 | 7 | 7 |
| 8 | 8 | 8 |
| 9 | 9 | 9 |
| 10 | 10 | 10 |
| J | Jack | 10 |
| Q | Queen | 10 |
| K | King | 10 |
| W | $19^{th}$ Hole Wild | −5 |
| Jkr | Joker | −2 |
| M | Mulligan | 0 |

After or while the players are arranging their layout cards according to the above described process, the dealer creates a draw pile and a discard pile from the cards which remain in the deck of cards after the layout cards have been dealt from the deck. The draw pile is a stack of cards in the face-down orientation. The draw pile is placed on the flat surface and made accessible to all of the players. The discard pile is a stack of cards in the face-up orientation, and is preferably placed next to the draw pile in a location which is accessible and visible to all of the players. The dealer draws a single card from the draw pile, turns it to the face-up orientation, and places it on the flat surface to establish the discard pile. As will be explained below, players will draw cards from the draw pile or discard pile and will discard unwanted cards to the discard pile.

Once each player has arranged his layout cards and the dealer has formed the draw pile and discard pile, game play can proceed to the substantive play in the round. In a complete game 100, the players preferably play nine rounds according to the below description. The object of each round, and thus of the entire game 100, is to have as low a score as possible. In this way, the card game 100 is similar to the scoring goals in the game of golf. At the beginning of the game 100, each player has a score of zero. As will be described, the values of the layout cards of each player are added to his score at the conclusion of each round. The player with the total score which is lowest among all players is declared the winner at the end of the game 100.

Each player turns two of his layout cards to the face-up orientation, as shown below in Example B and in step 103 in FIG. 1. In example B, a Joker card is in the (2,2) position and a King card is in the (3,3) position. Each player may select which of his own nine layout cards may be turned to the face-up orientation, and any two of his nine layout cards may be turned to the face-up orientation. Once a layout card is turned to the face-up orientation, it may not be returned to the face-down orientation.

*X X X* Example B

*X Jkr X*

*X X X*

Thus, at the start of the first round, each player has nine layout cards in the face-down orientation, and each player turns two of his layout cards to the face-up orientation. In a round, play commences with the player to the dealer's immediate left being provided with a turn, as shown in step 104. Each player, in turn, is provided with a turn, and game play moves sequentially to the next player to the left, as shown in step 105. The steps of each turn for a player are illustrated in FIG. 2.

During a turn, the player has the option to either draw a draw card from the draw pile or draw a discard card from the discard pile, as in step 201 in FIG. 2. Each of the draw and discard piles has a top card. The player may only draw the top card and may not draw any card below the top card. The top card in the draw pile is in the face-down orientation, and the top card in the discard pile is in the face-up orientation. Thus, the player is unaware of the card characteristics of the top card in the draw pile, but knows the card characteristics of the top card in the discard pile. The player is therefore presented with the decision to pick an unknown element or a known element and the risks associated with that decision.

If the player draws a draw card from the draw pile, as in step 202, the player is permitted to look at the face of the draw card. The player looks at the face of the draw card, as in step 203, and then decides to either discard the draw card or play the draw card, as in step 204. If the player discards the draw card, as in step 205, the player places the draw card on top of the discard pile in a face-up orientation, and that card becomes the top card in the discard pile. The player's turn then ends when the draw card has been discarded to the discard pile. If, on the other hand, the player decides to play the draw card, as in step 206, the player may play the draw card in one of two manners. In a first manner, the player replaces one of his layout cards which is in a face-up orientation with the draw card. The player does so by picking up the one of the layout cards which is in a face-up orientation, replacing it with the draw card in a face-up orientation as a layout card, as in step 207, and then placing it in the discard pile in a face-up orientation, as in step 208. The player's turn ends when the player has replaced the draw card as a layout card and discarded the one of the layout cards was in a face-up orientation. In a second manner, the player replaces one of the layout cards which is in a face-down orientation with the draw card. The player does so by picking up the one of the layout cards which is in a face-down orientation, replacing it with the draw card in a face-up orientation as a layout card, as in step 209, and then placing it in the discard pile in a face-up orientation, as in step 210. The player's turn then ends when he has replaced the draw card as a layout card and discarded the one of the layout cards which was in a face-down orientation. If the player chooses to proceed according to the second manner, then he must discard the selected one of the layout cards which is in a face-down orientation, even after revealing the face of that card. The player cannot look at or reveal the face of the one of the layout cards which is in a face-down orientation and then choose to not replace it with the drawn card.

If, instead of drawing a draw card from the draw pile at the outset of his turn, the player chooses to draw a discard card from the discard pile, then the player must play the discard card. The player cannot return the discard card to the discard pile; in other words, the player cannot simply draw and then discard the same discard card to end his turn. After drawing the discard card, the player may play the discard card in one of two manners, as in step 211. In a first manner, the player replaces one of the layout cards which is in a face-up orientation with the discard card. The player does so by picking up the one of the layout cards which is in a face-up orientation, replacing it with the discard card in a face-up orientation as a layout card, as in step 212, and then placing it in the discard pile in a face-up orientation, as in step 213. The player's turn ends when the player has replaced the discard card as a layout card and discarded the one of the layout cards which was in a face-up orientation. In a second manner, the player replaces one of the layout cards which is in a face-down orientation with the discard card. The player does so by picking up the one of the layout cards which is in a face-down orientation, replacing it with the discard card in a face-up orientation as a layout card, as in step 214, and then placing it in the discard pile in a face-up orientation, as in step 215. The player's turn ends when the player has replaced the discard card as a layout card and discarded the one of the layout cards which was in a face-down orientation. If the player chooses to proceed according to the second manner, then he must discard the selected one of the layout cards which is in a face-down orientation, even after revealing the face of that card. The player cannot look at or reveal the face of the one of the layout cards which was in a face-down orientation and then choose to not replace it with the discard card.

Once the player's turn has ended, the next player is provided with a turn, as in step 105. The next player is the player seated immediately to the left of the player who just ended his turn. The next player plays according to the description above, following steps 201 through 215 in FIG. 2, so that he plays according to the same rules as the previous player. Play continues with each subsequent player receiving a turn until one of the players has turned all of his layout cards to a face-up orientation, as in step 106 in FIG. 1. If no player has turned all of his layout cards to a face-up orientation, but the draw pile has been exhausted such that no cards remain, as in step 107, then the game 100 proceeds according to modified rules as in step 300, shown in FIG. 1 and detailed in FIG. 3. If, however, one of the players has turned all of his layout cards to a face-up orientation, that player is designated, for purposes of reference in this description only and not for play in the game 100, as an ender player. When the ender player has turned all of his layout cards to a face-up orientation, all other players are then provided with one additional, sequential turn to play, as in step 108. After all other players have played their respective additional turn, those players turn all of their layout cards to the face-up orientation, as in step 109. Round scores for the round are then determined, as in step 110.

If all of the players have at least one layout in a face-down orientation, but the draw pile has been exhausted and has no top card, then the next player plays according to modified game play, as in step 300 in FIG. 3. The player has the option to draw from the discard pile or to immediately end his turn, as in step 301. If the player chooses to end his turn, his turn ends immediately in step 302, and all players turn all of their layout cards to the face-up orientation, as in step 109 in FIGS. 3 and 1, and round scores are determined, as in step 110 in FIG. 1. If, instead, the player chooses to draw from the discard pile, the player chooses to draw a discard card from the discard pile, then the player must play the discard card. The player cannot return the discard card to the discard pile. After drawing the discard card, the player may play the discard card in one of two manners, as in step 303. In a first manner, the player replaces one of the layout cards which is in a face-up orientation with the discard card. The player does so by picking up the one of the layout cards which is in a face-up orientation, replacing it with the discard card in a face-up orientation as a layout card, as in step 304, and then placing it in the discard pile in a face-up orientation, as in step 305. The player's turn ends ion step 306 when the player has replaced the discard card as a layout card and discarded the one of the layout cards which was in a face-up orientation. In a second manner, the player replaces one of the layout cards which is in a face-down orientation with the discard card. The player does so by picking up the one of the layout cards which is in a face-down orientation, replacing it with the discard card in a face-up orientation as a layout card, as in step 307, and then placing it in the discard pile in a face-up orientation, as in step 308. The player's turn ends in step 306 when the player has replaced the discard card as a layout card and discarded the one of the layout cards which was in a face-down orientation. If the player chooses to proceed according to the second manner, then he must discard the selected one of the layout cards which is in a face-down orientation, even after revealing the face of that card. The player cannot look at or reveal the face of the one of the layout cards which was in a face-down orientation and then choose to not replace it with the discard card. The next player then begins his turn in step 309 according to the modified game play, with the option to draw from the discard pile or to immediately end his turn. Play continues in this manner according to the modified game play until one of the players has all of his layout cards in a face-up orientation or chooses to end his turn by not drawing from the discard pile. No penalty is applied to the score of the ender player under the modified game play.

Round scores are determined for each player based on the arrangement and values of his layout cards in a single round. Each card has a value corresponding to the characteristics of the card. Ace cards have a value of one, the numbered cards from two to ten each have a value corresponding to their number, face cards each have a value of ten, $19^{th}$ Hole Wild cards have a value of negative five, Joker cards have a value of negative two, and Mulligan cards have a value of zero. Table 1, above, lists values for each card. The value of each layout card is added to the round score for each player unless the layout card is melded according to the description below.

During scoring, melding occurs. Melding is the process of matching or organizing similar layout cards into melds, which are matches. Melding converts layout cards into melded cards. While all layout cards other than the Mulligan cards have a non-zero value, the value of a melded card is designated as zero. Thus, when a layout card is converted into a melded card, its value is converted from a non-zero value to a zero value.

A meld is formed among three layout cards. In a deck of 114 cards, and with melds possible only among similar cards and wild cards, as described below, the probability that the initial dealing has provided any player with a meld is very low at approximately 0.15%. It is thus extremely unlikely for any player to be dealt a meld initially, so each player must work to strategically form melds, by predicting the value of his layout cards in face-down orientations and comparing them with his layout cards in face-up orientations.

Layout cards are compared in the grid across each row, each column, the diagonal including the (1,1), (2,2), and (3,3) positions, and the diagonal including the (1,3), (2,2), and (3,1) positions. Melds are formed across the rows, columns, and diagonals in the grid. If the layout cards in a row have the same value, then those layout cards are part of a meld and are melded, converting them into melded cards. In Example C below, the top row of layout cards includes three Ace cards. Thus, while these three Ace cards would normally each have a value of one, because they are part of a meld, each is converted to a melded card and has a value of zero. The score for the player having the layout cards shown in Example C would be 28 (calculated from 0+0+0+3+9+10+5+(−5)+6).

| | | | |
|---|---|---|---|
| *A* | *A* | *A* | Example C |
| 3 | 9 | *K* | |
| 5 | *W* | 6 | |

Similarly, if the layout cards in a column have the same value, then those layout cards are part of a meld and are melded, converting them into melded cards. In Example D below, the middle column of layout cards includes three Nine cards. Thus, while these three nine cards would normally each have a value of nine, they are part of a meld and each is converted to a melded card and accorded a value of zero. The score for the player having the layout cards shown in Example D would be 26 (1+0+1+3+0+10+5+0+6).

| | | | |
|---|---|---|---|
| *A* | 9 | *A* | Example D |
| 3 | 9 | *K* | |
| 5 | 9 | 6 | |

If the layout cards in a diagonal have the same value, then those layout cards are part of a meld and are melded, converting them into melded cards. In Example E below, the diagonal of layout cards in the (1,1), (2,2), and (3,3) positions includes three Joker cards. Thus, while these three Jack cards would normally each have a value of ten, they are part of a meld, and so each is converted to a melded card and accorded a value of zero. The score for the player having the layout cards shown in Example E would be 37 (0+9+1+3+0+10+5+9+0).

| | | | |
|---|---|---|---|
| *J* | 9 | *A* | Example E |
| 3 | *J* | *K* | |
| 5 | 9 | *J* | |

If there are more than two melds in a player's layout cards, then each meld is formed and accounted for, with the layout cards in each meld being melded into melded cards, and leaving the other layout cards to be added to the score for the player. In Example F below, the left column and the bottom row of layout cards both include Ace cards. Thus, while each of the Ace cards would typically have a value of one, each value is set to zero because each Ace card is a melded card. The Ace card in the (1,3) position participates in the meld in the left column and in the meld in the bottom row. The score for the player having the layout cards shown in Example F would be 14 (0+5+2+0+3+4+0+0+0).

| | | | |
|---|---|---|---|
| *A* | 5 | 2 | Example F |
| *A* | 3 | 4 | |
| *A* | *A* | *A* | |

The $19^{th}$ Hole Wild card is a wild card. A wild card is one which can adopt the value of another layout card so as to form a meld with that layout card and another layout card. The $19^{th}$ Hole Wild card can meld with a pair of cards to form a meld. For example, in a row of layout cards including two nine cards and a $19^{th}$ Hole Wild card, the $19^{th}$ Hole Wild card emulates a third nine card, and the three layout cards are part of a meld. The $19^{th}$ Hole Wild card can also meld with another $19^{th}$ Hole Wild card. For example, in a column of layout cards including two $19^{th}$ Hole Wild cards and a third layout card, such as a four card, each $19^{th}$ Hole Wild card emulates a four card, so that a column of cards each having a value of four is formed, and each of the layout cards are part of a meld. The $19^{th}$ Hole Wild card can also meld with another wild card. For example, in a row of layout cards including a $19^{th}$ Hole Wild card, a Joker card, and a numbered card such as a three card, the $19^{th}$ Hole Wild card and the Joker card each emulate a three card, and the three layout cards are part of a meld.

Melding a wild card does not convert the value of the wild card. In a meld involving a $19^{th}$ Hole Wild card, the values of the numbered and face cards in the meld are set to zero, and the values of each $19^{th}$ Hole Wild card in the meld is preserved, or left at negative five. Similarly, in a meld involving a $19^{th}$ Hole Wild card, the value of each Joker card is preserved, or left at negative two. Thus, according to the principle of the invention, the player having the layout cards shown in Example G below, in which there is a meld including a pair of nine cards and a $19^{th}$ Hole Wild card, would have a score of 29 (9+4+9+0+(−5)+0+3+A+8). The player having the layout cards shown in Example H below, in which there is a meld including a four card and two $19^{th}$ Hole Wild cards, would have a score of 24 (0+10+6+(−5)+3+1+(−5)+9+5). The player having the layout cards as shown in Example I below, in which there is a meld including a three card, a $19^{th}$ Hole Wild card, and a Joker card, would have a score of 40 (10+10+10+7+8+2+(−5)+(−2)+3).

| | | | |
|---|---|---|---|
| 9 | 4 | 9 | Example G |
| 9 | *W* | 9 | |
| 3 | *A* | 8 | |
| 4 | *K* | 6 | Example H |
| *W* | 3 | *A* | |
| *W* | 9 | 5 | |
| *K* | *K* | *Q* | Example I |
| 7 | 8 | 2 | |
| *W* | *Jkr* | 3 | |

As mentioned above, the Joker card is also a wild card, and it can adopt the value of another card so as to form a meld with that card and another layout card. The Joker card can meld with a pair of cards having a number to form a meld of cards with that number. For example, in a column of layout cards including two six cards and a Joker card, the Joker card emulates a third six card, and the three layout cards are part of a meld. The Joker card can also meld with another Joker card and a third card. For example, in a diagonal of layout cards including two Joker cards and a third layout card, such as a seven card, each Joker card emulates a seven card, so that a diagonal of cards each having a value of seven is formed, and each of the layout cards are part of a meld. The score for a player having the layout cards shown in Example J below would be 28 ((−2)+7+6+2+7+2+10+3+7).

| | | | |
|---|---|---|---|
| *J* | 7 | 6 | Example J |
| 2 | 7 | 2 | |
| *K* | 3 | 7 | |

The Mulligan card has a value of zero and is not a wild card. It cannot participate in a meld unless that meld is formed by two other Mulligan cards, in which case the value of each melded card is still zero. The score for a player having the layout cards shown in Example K below would be 25 (1+7+0+2+0+2+6+3+4).

| | | | |
|---|---|---|---|
| *A* | 7 | *M* | Example K |
| 2 | *M* | 2 | |
| 6 | 3 | 4 | |

Once the round scores for each player are determined, the round score of the ender player is compared to the round score of each player. If any player has a round score which is lower than that of the ender player, the round score of the ender player is increased by 18. Thus, the ender player is penalized by 18 if the ender player does not have the lowest round score. In this way, the players will carefully consider whether any player desires to be the first player to turn up all of his layout cards, lest he be designated the ender player and risk being penalized by 18 if another player has a lower round score for that round. The round scores of each player are then added to their total scores, which are running scores for the game 100.

Once the scores for the round are determined and added to each player's total score, the round ends, as in step 111 in FIG. 1. Preferably, if nine rounds have not yet been played, another round begins according to the description above, as in step 112. If nine rounds have been played, then the game 100 ends at step 113, and the player with the lowest total score is declared the winner of the game 100.

The present invention is described above with reference to a preferred embodiment. However, those skilled in the art will recognize that changes and modifications may be made in the described embodiment without departing from the nature and scope of the present invention. To the extent that such modifications and variations do not depart from the spirit of the invention, they are intended to be included within the scope thereof.

Having fully and clearly described the invention so as to enable one having skill in the art to understand and practice the same, the invention claimed is:

1. A method of playing a card game between at least two players and with a deck of 114 cards, the method comprising the steps of:

providing a deck of 114 cards, each card having a face and a respective value, the deck consisting of seventy-two numbered cards, twenty-four face cards, eight ace cards, four joker cards, four mulligan cards, and two wild cards, wherein the values of the joker cards, mulligan cards, and wild cards differ;

playing a round until an ender player has all of their respective cards in a face-up orientation, the round comprising the steps of:

dealing layout cards from the deck of cards to the players in a face-down orientation;

creating a draw pile and a discard pile from the cards remaining in the deck of cards;

each player turning at least one of their layout cards to the face-up orientation;

each player, in turn, drawing a drawn card from one of the draw and discard piles;

upon drawing the drawn card from the discard pile, each player replacing one of their layout cards with the drawn card in the face-up orientation;

upon drawing the drawn card from the draw pile, each player either discarding the drawn card or replacing one of their layout cards with the drawn card in the face-up orientation;

turning all the layout cards to the face-up orientation; and ending the round by determining a round score of each player for the round based on the values of their respective layout cards, wherein determining a round score comprises:

melding the layout cards of each player into melded cards;

assigning a zero value to the melded cards; and for each player, summing the values of their layout cards which are not the melded cards into the round score for the player; and;

declaring a winner of the game corresponding to the player with the score which is lowest.

2. The method of claim 1, further comprising repeating the step of playing a round nine times.

3. The method of claim 2, wherein determining a round score further comprises assigning a penalty to the ender player if any other player has a round score lower than the round score of the ender player.

4. The method of claim 1, wherein the step of dealing layout cards includes dealing nine layout cards to each player.

5. The method of claim 1, further comprising the step of arranging the layout cards of each player into a grid having an equal number of rows and columns.

6. The method of claim 5, wherein the step of determining a score comprises:

melding the layout cards arranged linearly in the grid into melded cards;

assigning a zero value to each melded card which is a numbered card, face card, or ace card;

preserving the value of the melded cards which are either joker cards or wild cards; and summing the values of the layout and melded cards.

7. The method of claim 6, wherein the joker and wild cards meld with any card.

8. A method of playing a card game between at least two players and with a deck of 114 cards, the method comprising the steps of:

providing a deck of 114 cards, each card having a face and a respective value, the deck consisting of seventy-two numbered cards, twenty-four face cards, eight ace cards, four joker cards, four mulligan cards, and two wild cards, wherein the values of the joker cards, mulligan cards and wild cards differ; and playing a round comprising the steps of:

dealing layout cards from the deck of cards to the players in a face-down orientation;

creating a draw pile and a discard pile from the cards remaining in the deck of cards; and each player turning at least one layout card to a face-up orientation;

each player taking a turn until an ender player has all of their layout cards in the face-up orientation, each turn comprising the steps of:

the player drawing a drawn card from one of the draw and discard piles;

upon drawing a card from the discard pile, the player replacing one of their layout cards with the drawn card in the face-up orientation; and upon drawing a card from the draw pile, the player either discarding the drawn card or replacing one of their layout cards with the drawn card in the face-up orientation;

each player, other than the ender player, taking an additional turn;

each player, other than the ender player, turning their layout cards to the face-up orientation; and determining a score for each player by:

melding the layout cards of each player into melded cards;

assigning a zero value to the melded cards; and for each player, summing the values of their layout cards which are not the melded cards into the score for the player; and declaring a winner of the game corresponding to the player with the score which is the lowest.

9. The method of claim 8, further comprising repeating the step of playing a round nine times.

10. The method of claim 9, wherein the step of determining a score for each player further comprises assigning a penalty to the ender player if any other player has a lower score than the ender player.

11. The method of claim 8, wherein the step of dealing layout cards includes dealing nine layout cards to each player.

12. The method of claim 8, further comprising the step of arranging the layout cards of each player into a grid having an equal number of rows and columns.

13. The method of claim 12, wherein the step of determining a score for each player comprises:

the deck of cards comprises seventy-two numbered cards, twenty-four face cards, eight ace cards, four joker cards, four mulligan cards, and two wild cards, wherein the values of the joker cards, mulligan cards, and wild cards differ;

melding the layout cards arranged linearly in the grid into melded cards;

assigning a zero value to each melded card which is a numbered card, face card, or ace card;

preserving the value of the melded cards which are either joker cards or wild cards; and summing the values of the layout and melded cards.

14. The method of claim 13, wherein the joker and wild cards meld with any layout card.

15. The method of claim 13, wherein:

the value of each numbered card corresponds to a number appearing on the face of the card;

the value of each face card is ten;

the value of each ace card is one;

the value of each mulligan card is zero;

the value of each joker card is negative two; and the value of each wild card is negative five.

16. A method of playing a card game between at least two players and with a deck of 114 cards, the method comprising the steps of:

providing a deck of 114 cards, each card having a face and a respective value, the deck consisting of seventy-two numbered cards, twenty-four face cards, eight ace cards, four joker cards, four mulligan cards, and two wild cards;

playing a round comprising the steps of:

dealing nine layout cards from the deck of cards to each player in a face-down orientation;

creating a draw pile and a discard pile from the cards remaining in the deck of cards;

arranging the layout cards of each player into a grid of three rows and three columns;

each player turning at least one layout card to a face-up orientation;

each player taking a turn until an ender player has all of their layout cards in the face-up orientation, each turn comprising the steps of:

the player drawing a drawn card from one of the draw and discard piles;

upon drawing a card from the discard pile, the player replacing one of their layout cards with the drawn card in the face-up orientation; and upon drawing a card from the draw pile, the player either discarding the drawn card or replacing one of their layout cards with the drawn card in the face-up orientation;

each player, other than the ender player, taking an additional turn;

each player, other than the ender player, turning their layout cards to the face-up orientation;

melding the layout cards arranged linearly in the grid into melded cards of each player;

assigning a zero value to each melded card which is a numbered card, face card, or ace card;

preserving the value of the melded cards which are either joker cards or wild cards;

summing the values of the layout and melded cards into a score for each player; and declaring a winner of the game corresponding to the player with the score which is lowest.

17. The method of claim 16, further comprising the steps of:

assigning a penalty to the ender player if the score of any other player is lower than the score of the ender player; and wherein the joker and wild cards meld with any layout card;

the value of each numbered card corresponds to a number appearing on the face of the card;

the value of each face card is ten;

the value of each ace card is one;

the value of each mulligan card is zero;

the value of each joker card is negative two; and the value of each wild card is negative five.

* * * * *